US008882223B2

(12) United States Patent
Harris et al.

(10) Patent No.: US 8,882,223 B2
(45) Date of Patent: Nov. 11, 2014

(54) METHOD OF PRINTING WITH A SPLIT IMAGE REVOLUTION

(75) Inventors: Walter Sean Harris, Portland, OR (US); Joel Chan, West Linn, OR (US)

(73) Assignee: Xerox Corporation, Norwalk, CT (US)

( * ) Notice: Subject to any disclaimer, the term of this patent is extended or adjusted under 35 U.S.C. 154(b) by 107 days.

(21) Appl. No.: 13/562,642

(22) Filed: Jul. 31, 2012

(65) Prior Publication Data

US 2014/0035980 A1 Feb. 6, 2014

(51) Int. Cl.
*B41J 29/38* (2006.01)

(52) U.S. Cl.
USPC ..... 347/14; 347/9; 347/19

(58) Field of Classification Search
CPC ..... B41J 29/38
See application file for complete search history.

(56) References Cited

U.S. PATENT DOCUMENTS

| | | | | |
|---|---|---|---|---|
| 4,429,990 | A | 2/1984 | Tamary | |
| 4,593,992 | A | 6/1986 | Yoshinaga et al. | |
| 4,920,382 | A | 4/1990 | Mills et al. | |
| 5,132,739 | A | 7/1992 | Mauer et al. | |
| 5,325,155 | A | 6/1994 | Perry | |
| 5,327,204 | A | 7/1994 | Sculley et al. | |
| 5,353,107 | A | 10/1994 | Sculley et al. | |
| 5,523,830 | A | 6/1996 | Tamura et al. | |
| 5,610,721 | A | 3/1997 | Higuchi et al. | |
| 5,870,650 | A | 2/1999 | Takahashi et al. | |
| 6,035,157 | A | 3/2000 | Takahashi et al. | |
| 6,072,978 | A | 6/2000 | Wittmann | |
| 6,141,524 | A | 10/2000 | Berkes et al. | |
| 6,173,136 | B1 | 1/2001 | Fuchiwaki et al. | |
| 6,176,575 | B1 | 1/2001 | Crawford et al. | |
| 6,234,605 | B1 | 5/2001 | Hilton | |
| 6,263,174 | B1 | 7/2001 | Fuchiwaki et al. | |
| 6,449,455 | B1 | 9/2002 | Lebold et al. | |
| 6,731,891 | B1 | 5/2004 | Calamita et al. | |
| 6,763,219 | B2 | 7/2004 | Kobayashi et al. | |
| 6,954,603 | B2 | 10/2005 | Brown et al. | |
| 6,973,877 | B2 | 12/2005 | Jensen | |
| 7,052,125 | B2 * | 5/2006 | Askren et al. | 347/103 |
| 7,065,308 | B2 | 6/2006 | Calamita et al. | |
| 7,203,434 | B2 * | 4/2007 | Nakayama | 399/49 |
| 7,283,271 | B2 | 10/2007 | Sesek et al. | |
| 7,310,492 | B2 | 12/2007 | Kimura | |
| 7,362,994 | B2 | 4/2008 | Zess et al. | |
| 7,376,378 | B2 | 5/2008 | Van Bortel | |
| 7,390,084 | B2 | 6/2008 | Folkins | |
| 7,458,671 | B2 | 12/2008 | Leighton et al. | |
| 7,731,347 | B2 * | 6/2010 | Gordon et al. | 347/103 |
| 7,798,633 | B2 | 9/2010 | Folkins et al. | |
| 7,989,788 | B2 * | 8/2011 | Hawes et al. | 250/559.36 |
| 2006/0066657 | A1 | 3/2006 | Folkins et al. | |
| 2006/0239728 | A1 | 10/2006 | Van Bortel | |
| 2007/0020002 | A1 | 1/2007 | Zess et al. | |

(Continued)

*Primary Examiner* — Manish S Shah
*Assistant Examiner* — Jeremy Delozier
(74) *Attorney, Agent, or Firm* — Maginot, Moore & Beck LLP

(57) ABSTRACT

A method of indirect printing has been developed to split printing of an imaging revolution on the image drum. A portion of the image is printed on the drum corresponding from an intermediate edge to a trailing edge of image data, and subsequently a remaining portion is printed corresponding from a leading edge to the intermediate edge of the image data. Splitting the image revolution enables the imaging to begin earlier in the drum revolution and decreases the total number of revolutions needed to complete a printed page, increasing printer throughput.

16 Claims, 6 Drawing Sheets

(56) References Cited

U.S. PATENT DOCUMENTS

| | | | | |
|---|---|---|---|---|
| 2007/0040885 | A1* | 2/2007 | Kusunoki | 347/102 |
| 2007/0110457 | A1 | 5/2007 | Kato et al. | |
| 2007/0139496 | A1 | 6/2007 | Leighton et al. | |
| 2007/0146459 | A1 | 6/2007 | Gault et al. | |
| 2007/0146460 | A1 | 6/2007 | Gordon et al. | |
| 2007/0146461 | A1 | 6/2007 | Islam et al. | |
| 2009/0184996 | A1* | 7/2009 | Masuda et al. | 347/28 |
| 2010/0053259 | A1* | 3/2010 | Groenenboom et al. | 347/32 |
| 2010/0245447 | A1 | 9/2010 | Kohne et al. | |
| 2011/0221804 | A1 | 9/2011 | Kohne et al. | |

* cited by examiner

METHOD OF PRINTING WITH A SPLIT IMAGE REVOLUTION

TECHNICAL FIELD

This disclosure relates generally to inkjet printers and, in particular, to inkjet printers that eject ink onto an intermediate image drum.

BACKGROUND

Drop-on-demand inkjet printing systems eject ink droplets from printhead nozzles in response to pressure pulses generated within the printhead by either piezoelectric devices or thermal transducers, such as resistors. The ejected ink droplets, commonly referred to as pixels, are propelled to specific locations on an image receiving member where each ink droplet forms a spot on the member. The printheads include a faceplate having a plurality of droplet ejecting nozzles and a plurality of ink containing channels, typically one channel for each nozzle, which interconnect an ink reservoir in the print head with the nozzles.

In a typical piezoelectric inkjet printing system, the pressure pulses that eject liquid ink droplets are produced by applying an electric pulse to the piezoelectric devices, one of which is located within each of the inkjet channels. Each piezoelectric device is individually addressable to enable a firing signal to be generated and delivered for each piezoelectric device. The piezoelectric device deforms in response to receiving the firing signal, pressurizing a volume of liquid ink adjacent the piezoelectric device. As the ink is pressurized in a selected channel, a quantity of ink is displaced from the channel and a droplet of ink is mechanically ejected from the nozzle. The ejected droplets form an image on the image receiving member opposite the printhead. The respective channels from which the ink droplets are ejected are refilled by capillary action from an ink supply.

In some printers, the image receiving member is a rotating drum or belt coated with a release agent and the ink is a phase-change ink, which is solid at room temperature and transitions to a liquid phase at an elevated temperature. The printhead ejects droplets of liquid phase-change ink onto the rotating image receiving member to form an image, which is then transferred to a recording medium, such as paper. A drum maintenance unit or other release agent applicator prepares the image receiving member for receipt of the ejected ink by applying a layer of release agent to an imaging area on the image receiving member. The layer of release agent on the image receiving member forms a surface on which the ink image is formed and facilitates the transfer of the ink image from the receiving member to a recording medium. The transfer is generally conducted in a nip formed by the rotating image member and a rotating pressure roller, which is also known as a transfix roller. As the recording medium is transported through the nip, the fully formed image is transferred from the image receiving member to the recording medium and concurrently fixed thereon. This technique of using heat and pressure at a nip to transfer and fix an image to a recording medium passing through the nip is typically known as "transfixing."

The time required for image generation and transfer is controlled in an indirect printer by the frequency at which the inkjet ejectors can be operated, the overhead operations required to prepare the image receiving member and transfer the image from the image receiving member to recording media, and the number of revolutions of the image drum required for these processes. Reducing the number of revolutions of the image receiving member needed for each print can reduce the time required to print an image. Thus, printing in a manner that reduces the number of revolutions of the image receiving member would be beneficial to improved printer throughput.

SUMMARY

In one embodiment a method of operating a printer with a split imaging revolution to enable improved printer throughput has been developed. The method comprises rotating a drum in a process direction past a printhead and operating the printhead with reference to a first portion of image data stored in a memory to eject ink onto the drum as the drum rotates past the printhead in the process direction, the first portion of the image data corresponding from an intermediate edge in the image data to one of a trailing edge and a leading edge. The method further includes operating the printhead with reference to a remaining portion of the image data stored in the memory to eject ink onto the drum as the drum rotates past the printhead in the process direction, the remaining portion of the image data corresponding from the other of the trailing edge and the leading edge to an edge within the image data that is adjacent the intermediate edge.

In another embodiment a printer that prints with a split imaging revolution to enable improved throughput has been developed. The printer includes a printhead, a drum configured to rotate past the printhead in a process direction, and a controller operatively connected to the printhead. The controller is configured to operate the printhead with reference to a first portion of image data stored in a memory to eject ink onto the drum as the drum rotates past the printhead in the process direction, the first portion of the image data corresponding from an intermediate edge in the image data to one of a trailing edge and a leading edge. The controller is further configured to operate the printhead with reference to a remaining portion of the image data stored in the memory to eject ink onto the drum as the drum rotates past the printhead in the process direction, the remaining portion of the image data corresponding from the other of the trailing edge and the leading edge to an edge within the image data that is adjacent the intermediate edge.

DETAILED DESCRIPTION

Figure 1:
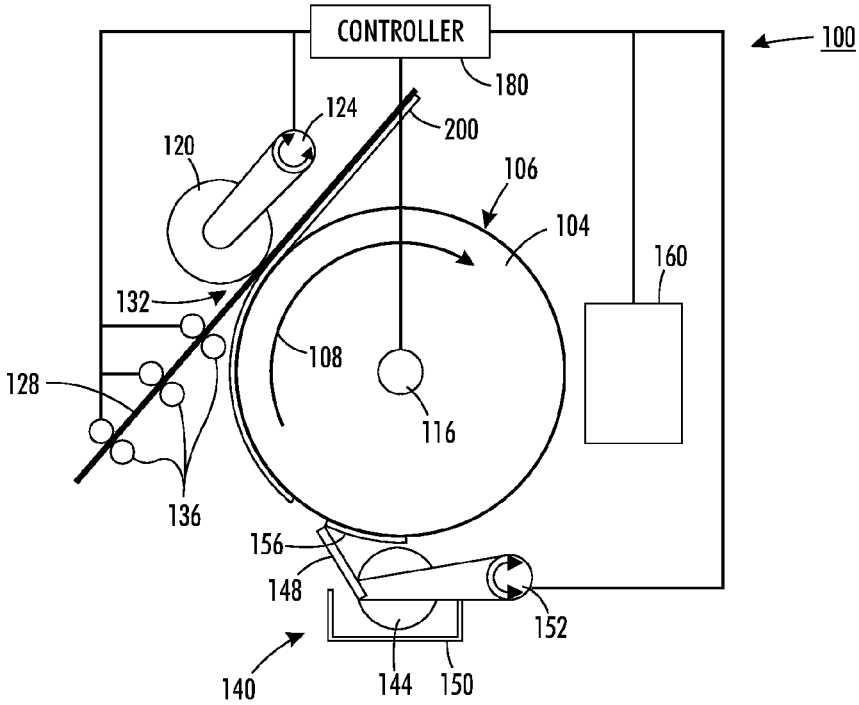
FIG. 1 is a side view of a printing system transfixing a previous ink image and applying release agent.

For a general understanding of the present embodiments, reference is made to the drawings. In the drawings, like reference numerals have been used throughout to designate like elements. As used herein, the terms "printer," "printing device" or "imaging device" generally refer to a device that produces an image with one or more colorants on print media and may encompass any such apparatus, such as a digital copier, bookmaking machine, facsimile machine, multi-function machine, or the like, which generates printed images for any purpose. Image data generally include information in electronic form which are rendered and used to operate the inkjet ejectors to form an ink image on the print media. These data may include text, graphics, pictures, and the like. The operation of producing images with colorants on print media, for example, graphics, text, photographs, and the like, is generally referred to herein as printing or marking.

Phase-change ink printers use phase-change ink, also referred to as a solid ink, which is in a solid state at room temperature but melts into a liquid state at a higher operating temperature. The liquid ink drops are printed onto an image receiving member in either a direct or indirect printer. Printers apply a coating of release agent to selected components in the printer, for example an imaging drum, to prevent phase-change ink from adhering to the printer components instead of the print medium. In one embodiment, the release agent is an oil such as silicone oil.

The term "printhead" as used herein refers to a component in the printer that is configured with inkjet ejectors to eject ink drops onto an image receiving surface. A typical printhead includes a plurality of inkjet ejectors that eject ink drops of one or more ink colors onto the image receiving surface in response to firing signals that operate actuators in the inkjet ejectors. The inkjets are arranged in an array of one or more rows and columns. In some embodiments, the inkjets are arranged in staggered diagonal rows across a face of the printhead. Various printer embodiments include one or more printheads that form ink images on an image receiving surface. Some printer embodiments include a plurality of printheads arranged in a print zone. An image receiving surface, such as a print medium or the surface of an intermediate member that carries an ink image, moves past the printheads in a process direction through the print zone. The inkjets in the printheads eject ink drops in rows in a cross-process direction, which is perpendicular to the process direction across the image receiving surface.

In an indirect printer, the printheads eject ink drops onto the surface of an intermediate image receiving member, for example, a rotating drum or an endless belt. A transfix roller is selectively positioned against the intermediate image receiving member to form a transfix nip. As a media sheet passes through the transfix nip in synchronization with the ink image on the intermediate image receiving member, the ink image transfers and fixes to the media sheet under pressure and heat in the transfix nip. The transfer and fixation of the ink image are well known to the art and are referred to as a transfix process.

Figure 9:
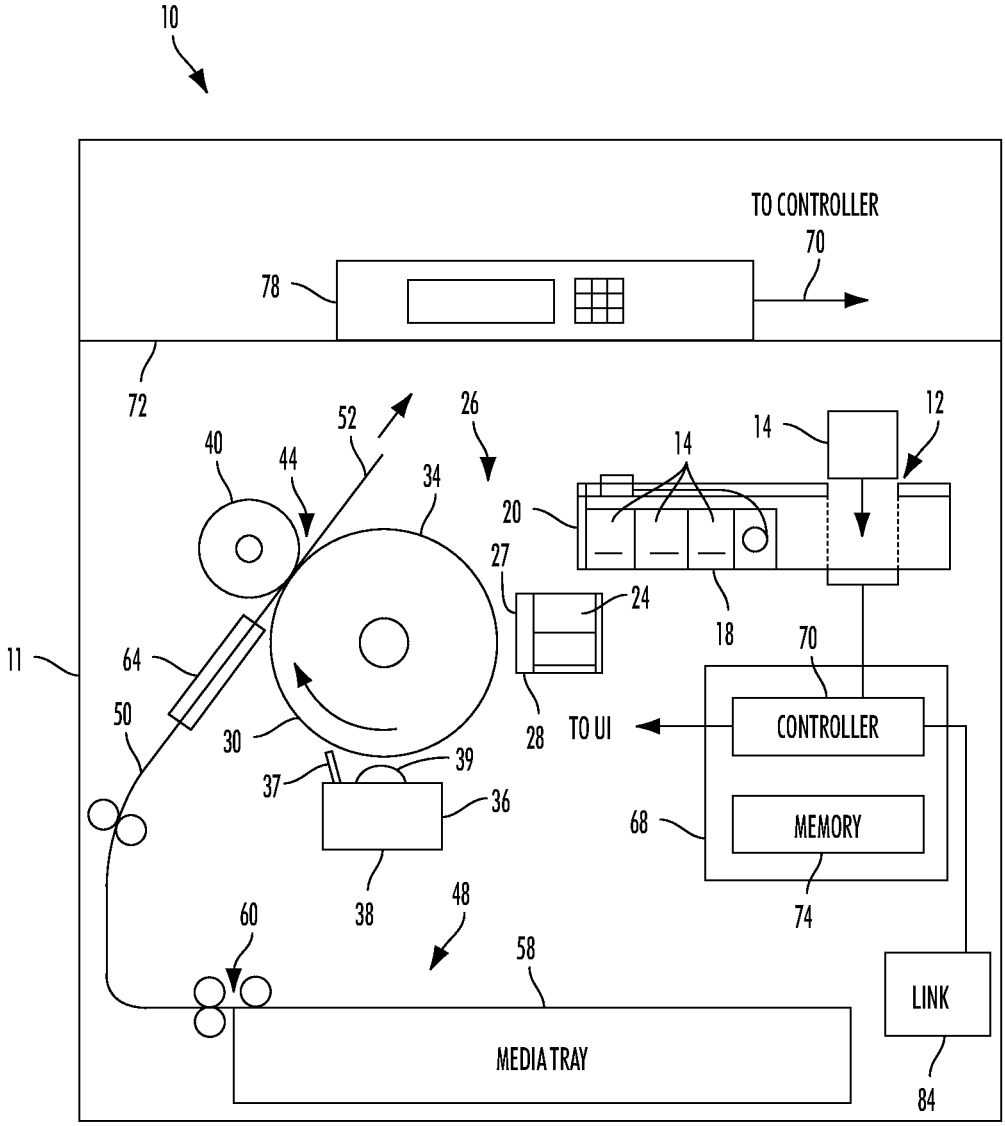
FIG. 9 PRIOR ART
FIG. 9 is a schematic view of a prior art indirect printer.

FIG. 9 is a side schematic view of a prior art indirect printing device 10. The device 10 includes a housing 11 that supports and at least partially encloses an ink loader 12, a printing system 26, a media supply and handling system 48, and a control system 68. The ink loader 12 receives and delivers solid ink to a melting device for generation of liquid ink. The printing system includes a plurality of inkjet ejectors that are fluidly connected to receive the melted ink from the melting device. The inkjet ejectors eject drops of liquid ink onto the image transfer surface 30 under the control of system 68. The media supply and handling system 48 extracts media from one or more media supplies in the printer 10, synchronizes delivery of the media to a transfix nip 44 for the transfer of an ink image from the image receiving surface to the media, and then delivers the printed media to an output area.

In more detail, the ink loader 12 is configured to receive phase change ink in solid form, such as blocks of ink 14, which are commonly called ink sticks. The ink loader 12 includes feed channels 18 into which ink sticks 14 are inserted. Although a single feed channel 18 is visible in FIG. 9, the ink loader 12 includes a separate feed channel for each color or shade of color of ink stick 14 used in the printer 10. The feed channel 18 guides ink sticks 14 toward a melting assembly 20 at one end of the channel 18 where the sticks are heated to a phase change ink melting temperature to melt the solid ink to form liquid ink.

The melted ink from the melting assembly 20 is directed gravitationally or by actuated systems, such as pumps, to a melt reservoir 24. The ink reservoir 24 comprises a printhead reservoir that supplies melted ink to inkjet ejectors 27 formed in the printhead 28. The ink reservoir 24 may be integrated into or intimately associated with the printhead 28 to enable the reservoir 24 to supply the ink to the ejectors 27.

The printing system 26 includes a printhead 28, an image receiving member 34, a drum maintenance unit (DMU) 36, and a transfix roller 40. The printhead 26 is operated in accordance with firing signals generated by the control system 68 to eject drops of ink toward the image receiving member 34. The DMU 36 includes a release agent reservoir 38, a release agent applicator 39, and a metering blade 37. The release agent applicator 39 absorbs release agent from the reservoir 38 and applies a layer of release agent to the surface 30 of the image receiving member 34 prior to the printhead forming the image on the surface 34 to facilitate transfer of the ink image formed on the image receiving member 34 to a media sheet 52. The metering blade 37 spreads the release agent applied by the applicator 39 into a uniform layer across the surface 30 of the image receiving member 34.

The image receiving member 34 is a rotating drum having an image receiving surface 30 on which the inkjet ejectors 27 in the printhead 28 eject ink drops. A transfix roller 40 is configured for movement into and out of engagement with the image receiving member 34 and the control system 68 selectively operates an actuator (not shown) to implement this movement. The transfix roller 40 is loaded against the transfer surface 30 of the image receiving member 34 to form a nip 44 through which sheets of print media 52 pass. The sheets are fed through the nip 44 in timed registration with an ink image formed on the transfer surface 30. Pressure, and in some cases heat, is generated in the nip 44 to facilitate the transfer of the ink drops from the surface 30 to the print media 52 in conjunction with release agent to substantially prevent the ink from adhering to the image receiving member 34.

The media supply and handling system 48 of printer 10 transports print media along a media path 50 that passes through the nip 44. The media supply and handling system 48 includes a supply tray 58 for storing media sheets until needed for printing and rollers 60 for transporting media along the media path 50 to the nip 44 and the output. A preheating assembly 64 brings print media 52 on media path 50 to an initial predetermined temperature prior to reaching the nip 44 to facilitate ink transfer to the print media 52.

A control system 68 aids in operation and control of the various subsystems, components, and functions of the printer 10. The control system 68 is operatively connected to one or more image sources, such as a scanner, to receive and manage image data from the sources and to generate control signals that are delivered to the components and subsystems of the printer. Some of the control signals are based on the image data, such as the firing signals, and these firing signals operate the printheads as noted above. Other control signals, for example, control the operating speeds, power levels, timing, actuation, and other parameters, of the system components to cause the imaging device 10 to operate in various states, modes, or levels of operation, referred to collectively herein as operating modes. These operating modes include, for example, a startup or warm up mode, shutdown mode, various print modes, maintenance modes, and power saving modes.

The control system 68 includes a controller 70, electronic storage or memory 74, and a user interface (UI) 78. The controller 70 comprises a processing device, such as a central processing unit (CPU), an application specific integrated circuit (ASIC), a field programmable gate array (FPGA) device, or a micro-controller. The one or more processing devices comprising the controller 70 are configured with programmed instructions that are stored in the memory 74. The controller 70 executes these instructions to operate the components and subsystems of the printer. Any suitable type of memory or electronic storage may be used. For example, the memory 74 may be a non-volatile memory, such as read only memory (ROM), or a programmable non-volatile memory, such as EEPROM or flash memory.

User interface (UI) 78 comprises a suitable input/output device located on the imaging device 10 that enables operator interaction with the control system 68. For example, UI 78 can include a keypad and display (not shown). The controller 70 is operatively connected to the user interface 78 to receive signals indicative of selections and other information input to the user interface 78 by a user or operator of the device and to display information to a user or operator including selectable options, machine status, consumable status, and the like. The controller 70 is coupled to a communication link 84, such as a computer network, for receiving image data and user interaction data from remote locations.

FIG. 1 depicts a printing system 100 for an indirect printer. The printing system includes an image drum 104, a transfix roller 120, a drum maintenance unit 140, a printhead 160, a media transport 136, and a controller 180. The image drum 104 includes a surface 106 on which the printhead 160 ejects ink and the drum maintenance unit 140 applies release agent, and a drum actuator 116 configured to rotate the image drum 104 at one of two predetermined angular velocities in a process direction 108. The drum actuator 116 can be any suitable actuator capable of rotating and regulating the speed at which the image drum 104 rotates.

The transfix roller 120 includes a transfix actuator 124, which is configured to move the transfix roller 120 into engagement with the image drum 104 to form a nip 132 and to disengage the transfix roller 120 from the image drum 104 to enable release agent and ink on the drum 104 to pass by the transfix roller 120 without contacting the roller. The actuator 124 presses the transfix roller 120 into the image drum 104 under pressure to form the nip 132 to transfer ink from the drum 104 to the media sheet 128 and fix the ink to the media sheet 128. Optionally, the transfix roller is heated to facilitate transfer of the ink image to the media. The media transport 136 is configured to move media sheets, such as media sheet 128, from a media supply (not shown) into the nip 132 as an ink image, such as ink image 200, reaches the nip 132 to enable the ink image to transfix to the media sheet.

The drum maintenance unit (DMU) 140 includes a release agent applicator 144, a metering blade 148, a release agent reservoir 150, and a DMU actuator 152. In the embodiment of FIG. 1-6, the release agent applicator 144 is in the form of a roller formed of an absorbent material, for example, extruded polyurethane foam. In other embodiments, the DMU can include any device or combination of devices, for example, wicking members and/or wipers, which can apply a coating of release agent to the image drum. The release agent applicator 144 of the illustrated embodiment absorbs release agent from the release agent reservoir 150 and applies the release agent to the surface 106 of the image drum 104. The DMU actuator 152 is operatively connected to the metering blade 148 and the release agent applicator 144, and is configured to move the metering blade 148 and release agent applicator 144 in and out of contact with the surface 106 of the image drum 104 to selectively apply release agent to the drum 104. The metering blade 148 wipes excess release agent from the image drum 104, leaving a thin coating of release agent on the surface 106 of the image drum 104.

The controller 180 is operatively connected to and configured to operate the actuators 116, 124, and 152, the media transport 136, and the printhead 160. The controller can be implemented with general or specialized programmable processors that execute programmed instructions. The instructions and data required to perform the programmed functions are stored in memory associated with the processors or controllers. The processors, their memories, and interface circuitry configure the controllers and/or print engine to perform the functions described above and the process described below. These components can be provided on a printed circuit card or provided as a circuit in an application specific integrated circuit (ASIC). Each of the circuits can be implemented with a separate processor or multiple circuits can be implemented on the same processor. Alternatively, the circuits can be implemented with discrete components or circuits provided in VLSI circuits. Also, the circuits described herein can be implemented with a combination of processors, ASICs, discrete components, or VLSI circuits.

FIG. 1 depicts the printing system 100 as the system 100 completes transfixing a previous ink image 200 to a previous media sheet 128. The drum actuator 116 rotates the drum 104 in the process direction 108 as the transfix actuator 124 urges the transfix roller 120 into contact with the image drum 104 under pressure to form the nip 132. The previous ink image 200 transfers to the media sheet 128 as the media transport 136 and the rotating image drum 104 moves the media sheet 128 through the nip 132. As the trailing edge of the previous ink image 200 passes by the metering blade 148, the DMU actuator 152 activates to move the release agent applicator 144 and metering blade 148 into engagement with the image drum 104 to begin applying a release agent coating 156 to the surface 106 of the image drum 104 as the previous ink image 200 is transfixed to the media sheet 128.

Figure 2:
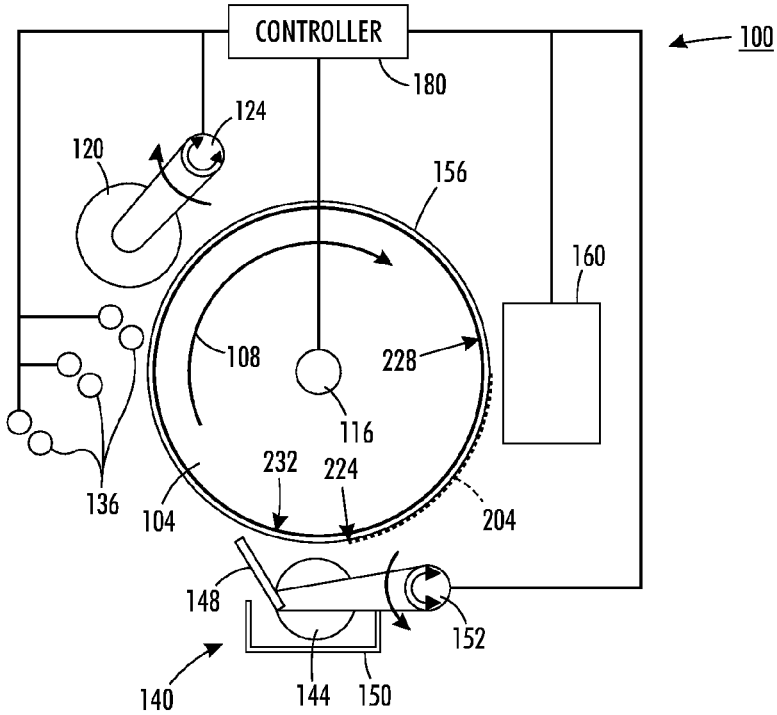
FIG. 2 is a side view of the printing system of FIG. 1 ejecting ink corresponding to a first portion of a first revolution of an ink image onto an image drum.

As the trailing edge of the media sheet exits the nip and the leading edge of the release agent coating 156 approaches the nip, the transfix actuator 124 moves the transfix roller 120 out of engagement with the image drum 104 and the drum actuator 116 accelerates the image drum 104 from a transfix velocity to an imaging velocity. As shown in FIG. 2, the printhead 160 begins to eject ink onto the surface of the drum 104 as the drum after a portion of the leading edge of the release agent coating 156 has passed the printhead 160 in the process direction 108. The printhead 160 is operated with reference to an interior portion in the image data stored in the memory of the printer to a trailing edge of the image data in the memory. This operation forms a first portion of an ink image 204 having an intermediate edge 224 of the ink image that extends to trailing edge 228 of the ink image. Although the embodiment of FIG. 1-7 depicts the intermediate edge as being substantially halfway between the leading and trailing edges, the reader should appreciate that the intermediate edge can be at any suitable location between the leading and trailing edge. As the intermediate edge 224 approaches the release agent applicator 144, the DMU applicator 144 completes application of release agent to the entire circumference of the drum 104 with some overlap at the leading edge of the release agent coating 156 and the DMU actuator 152 disengages the release agent applicator 144 and metering blade 148 from with the image drum 104 at position 232 to enable the ink on the drum to pass by the DMU 140 without being smeared.

Figure 3:
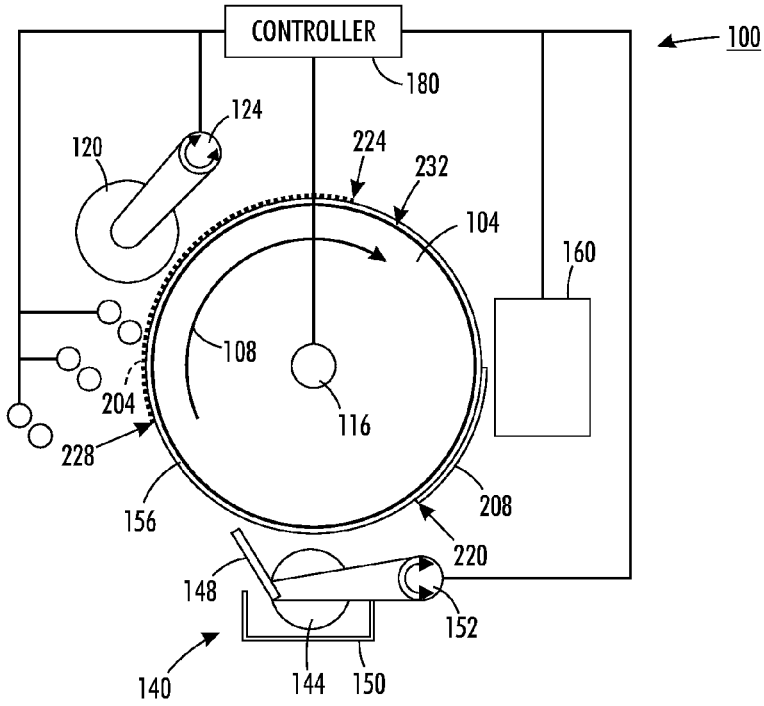
FIG. 3 is a side view of the printing system of FIG. 1 ejecting additional ink onto the image drum in subsequent revolutions.

As illustrated in FIG. 3 the printhead 160 ceases printing at a trailing edge 228 of the ink image as the drum 104 continues to rotate in the process direction 108. As discussed in more detail below, the printhead 160 is then moved in a cross-process direction and operated with reference to the leading edge of the image data in memory to begin forming a leading edge 220 of a portion of the ink image and continue printing of the portion of the ink image 208 up to the trailing edge 228 with reference to the image data stored in the memory up to the trailing edge. This printing of an ink image portion from a leading edge up to a trailing edge is performed during a single revolution of the image drum 104. In the formation of this portion of the ink image, the printhead 160 is operated to eject ink over the position 232 on the drum where the release agent applicator 144 overlapped the leading edge of the release agent coating 156 before being disengaged from the drum 104. The printhead 160 continues to move in the cross-process direction and print additional portions of the ink image with reference to the image data stored in the memory from the leading edge of the image data to the trailing data of the image data as the drum makes additional revolutions. In one embodiment, the printhead 160 prints five additional revolutions, while in another embodiment, the printhead 160 prints thirteen additional revolutions. While the printing system of the illustrated embodiment prints one or more additional revolutions between the split image revolution, the reader will appreciate that a printing system can operate with a split image revolution without printing additional revolutions between the split revolution.

Figure 4:
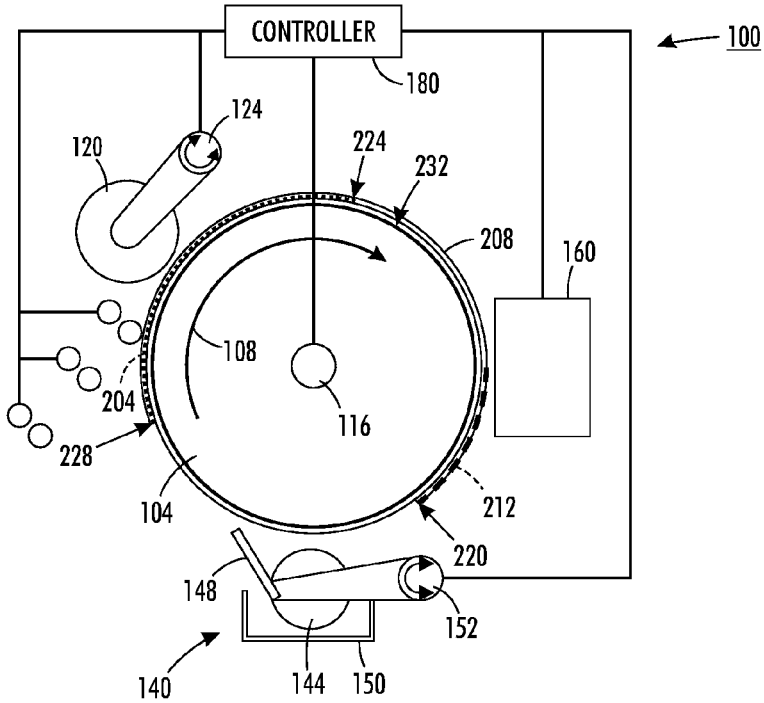
FIG. 4 is a side view of the printing system of FIG. 1 ejecting ink corresponding to a remaining portion of the first revolution of the ink image onto the image drum.
Figure 5:
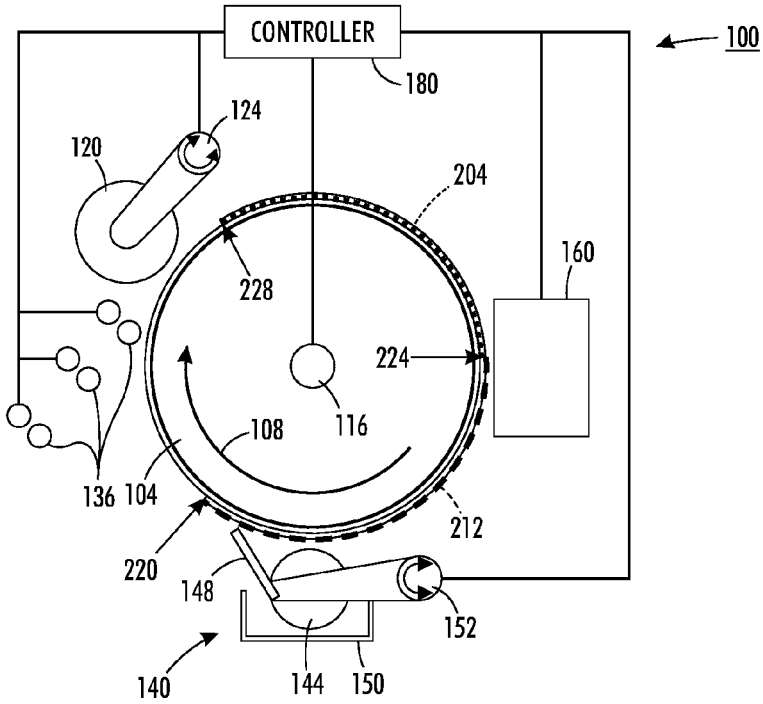
FIG. 5 is a side view of the printing system of FIG. 1 completing the printing of the ink image.

As shown in FIG. 4, once the printhead 160 completes printing the additional revolutions 208 to extend the ink image in the cross-process direction across the drum 104, the printhead 160 prints a remaining portion 212 of the ink image with reference to the image data stored in the memory from the leading edge in the memory to the position adjacent to where the printing began on the first print revolution. The printhead 160 is moved in the cross process direction to align with the first portion printed on the first revolution. In one embodiment the printhead 160 moves in the cross-process direction to a position where each line of pixels in the process direction for the remaining portion is aligned with the inkjet adjacent to the inkjet that printed the same pixel line in the first portion. In other embodiments the printhead can move back to the initial position or to an alignment more than one inkjet from the inkjet that printed the first portion. The inkjets are then operated to commence ejecting ink with reference to the leading edge of the image data stored in the memory to form the leading edge 220 of the ink image on the drum 104. The remaining portion 212 corresponds from the leading edge 220 to the position adjacent the intermediate edge 224, completing the split revolution of the ink image as the intermediate edge 224 passes the printhead, as shown in FIG. 5.

Figure 6:
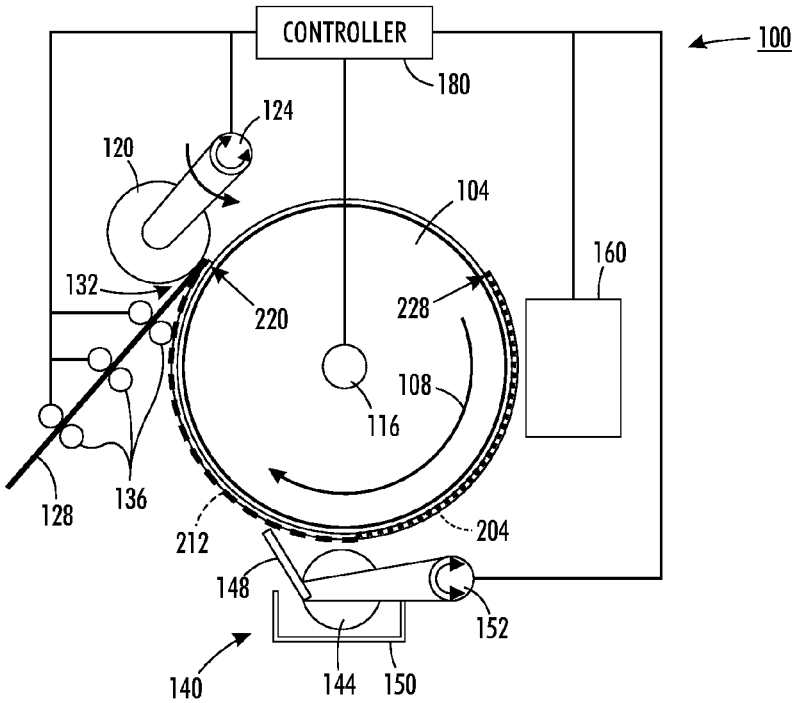
FIG. 6 is a side view of the printing system of FIG. 1 beginning to transfix the ink image to a media sheet.

Once the remaining ink image portion 212 is printed, the ink image is completed and the drum actuator 116 decelerates the image drum 104 to the transfix velocity. In one embodiment, the image drum is in a position to decelerate to the transfix velocity immediately after the remaining portion of the first imaging revolution is completed, avoiding excess rotation of the image drum. As the leading edge 220 of the ink image approaches the transfix roller 120, the transfix actuator 124 moves the transfix roller 120 into engagement with the image drum 104 to form the nip 132. As shown in FIG. 6, the media transport 136 is operated to insert a media sheet 128 into the nip 132 as the leading edge 220 of the ink image 204, 208, and 212 on the drum 104 enters the nip to begin transfixing the ink image to the media sheet 128. The imaging process can then repeat from the position shown in FIG. 1 to print another media sheet.

Figure 7:
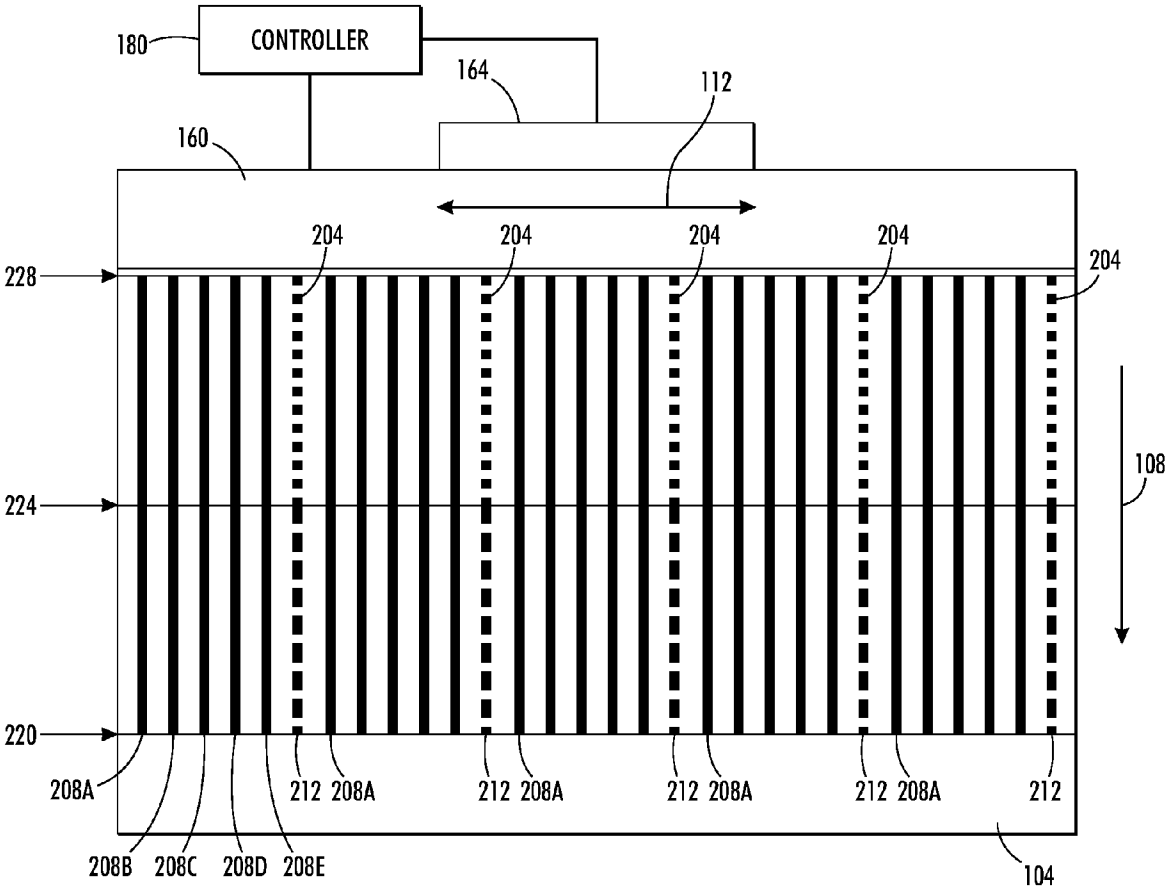
FIG. 7 is a view of the surface of the drum of the printing system of FIG. 1.

FIG. 7 depicts a completed ink image, not shown to scale, on the surface 106 of the drum 104, which, for clarity of description, illustrates each revolution printing lines spaced from one another. However, the reader will appreciate that an actual printed image includes hundreds of adjacent pixels per inch in the cross-process direction, and that the printhead need not print lines for each revolution. The drum 104 moves in process direction 108, moving the leading edge 220, the intermediate edge 224, and the trailing edge 228 past the printhead in sequence. The printhead actuator 164 is configured to move the printhead 160 in the cross-process direction 112 between each of the imaging revolutions to enable the printhead 160 to print different portions of the ink image on each revolution. In the embodiment of FIG. 7, the printhead 160 is configured to print six total revolutions, printing every sixth pixel in the cross-process direction with each revolution. For example, the first portion 204 of the split revolution is printed from the intermediate edge 224 to the trailing edge 228. Next, the printhead 160 is moved in the cross-process direction 112 by the actuator 164 to print a complete revolution from the leading edge 220 to the trailing edge 228 of the ink image, for example, revolution 208A, corresponding to the pixels adjacent to the pixels of the first portion 204 in the cross-process direction. The printhead 160 moves and prints revolutions 208B, C, D, and E as the drum 104 continues to rotate, and then proceeds to align the printhead 160 with the first portion 204 and print the remaining portion 212 of the first revolution from the leading edge 220 to the intermediate edge 224. In alternative embodiments, the printing revolutions can be printed in any order and the ink image can be printed in more or fewer revolutions, depending on the printhead characteristics, the desired image resolution, and printing speed. In another embodiment, the printhead is configured to move in the cross-process direction as the inkjets in the printhead eject ink during the imaging revolutions. The printhead essentially forms a series of sloped lines spaced from one another with each imaging revolution. To complete the remaining portion of the first revolution, the printhead is positioned at the leading edge to enable the remaining portion to align with the first portion once the intermediate edge of the first portion on the drum passes the moving printhead.

Figure 8:
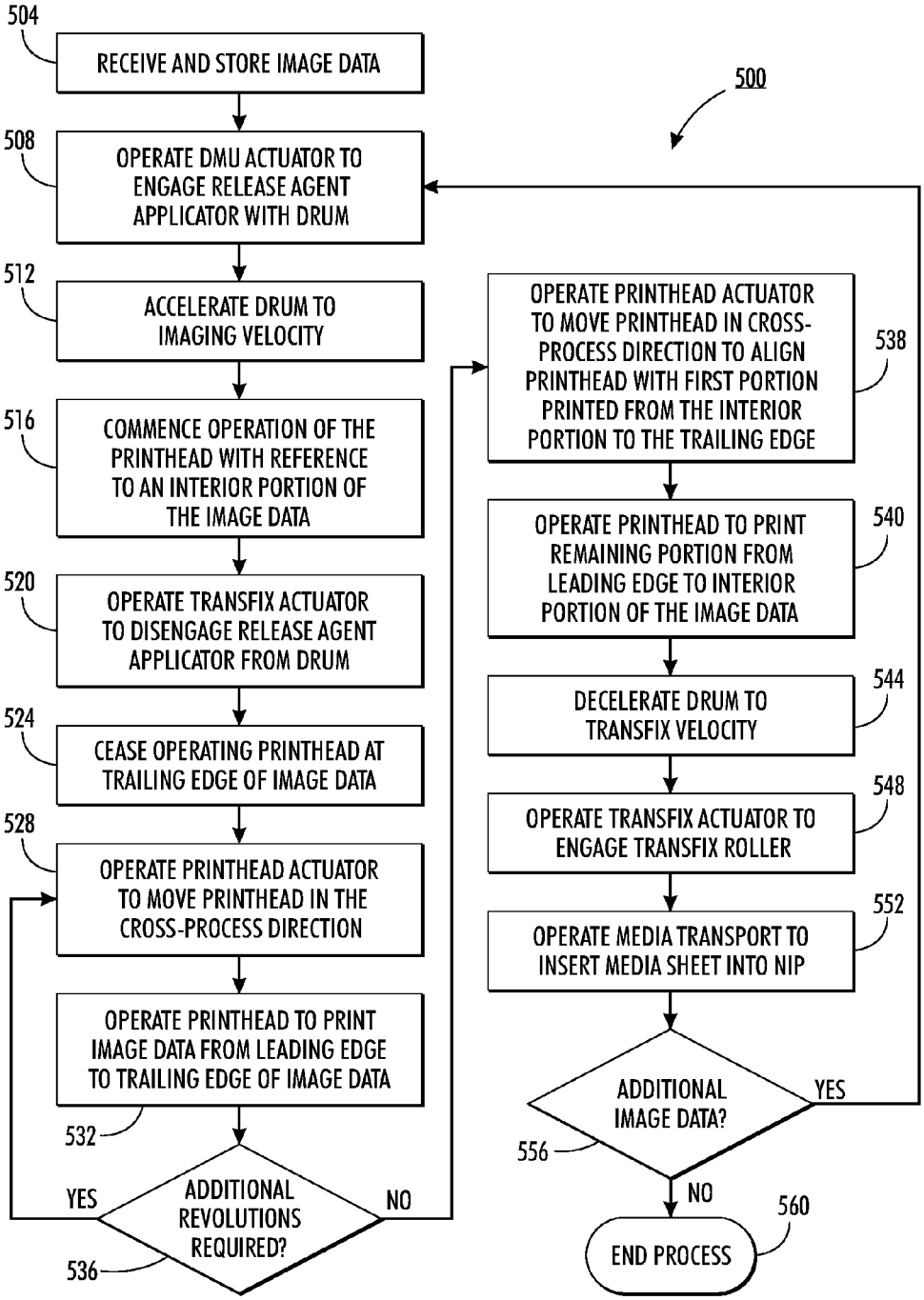
FIG. 8 is a process diagram of a process of printing using a split image revolution.

FIG. 8 depicts a process 500 for printing using a split image revolution. The process 500 refers to a controller, such as the controller 180 described above, executing programmed instructions stored in a memory operatively connected to the controller to cause the controller to operate one or more components of the printer to perform the specified function or action described in the process.

The controller implementing the process begins by receiving and storing electronic image data corresponding to an image to be printed in memory (block 504). The electronic image data can be received from a computer or other electronic device operatively connected to the printer, from a scanner that is a component of the printer, or otherwise electronically or optically generated and delivered to the controller. The controller then operates an actuator to engage the release agent applicator with the image drum to apply a coating of release agent to the drum (block 508). The controller accelerates the drum to an imaging velocity that is suitable for ejecting ink droplets on the drum corresponding to the image data (block 512). If the printer is still transfixing a previous media sheet, the controller is programmed to wait until the previous media sheet has passed through the transfix nip before accelerating the drum to the image velocity to complete the transfixing at the transfix velocity. If no previous media sheet is in the transfix nip, the controller accelerates the image drum to the imaging velocity immediately.

Once the portion of the drum on which release agent has been applied has passed the printhead, the controller generates electrical signals that operate the printhead to begin ejecting ink with reference to an interior portion of the image data to form a first portion of the ink image (block 516). The controller then operates an actuator to disengage the release agent applicator from the drum before the intermediate edge reaches the release agent applicator to ensure that the release agent applicator completes application of release agent to the drum and while preventing the ink ejected on the drum from contacting the applicator (block 520). The controller ceases operating the printhead when the trailing edge of the image data is used to operate the printhead and complete the printing of the first portion of the ink image on the drum (block 524), completing the first portion of the first revolution of the image data corresponding from the interior position in the image data to the trailing edge of the image data.

Next, the controller operates a printhead actuator to move the printhead in the cross-process direction to enable the printhead to eject ink in locations on the image drum where ink was not printed in the first portion of the first revolution (block 528). The controller can operate the printhead actuator to move the printhead by a single pixel, by a predetermined number of pixels, or across a length of the drum that is approximately the same width as the printhead to enable the printhead to print additional portions of the ink image. The controller then operates the printhead with reference to the image data from the leading edge to the trailing edge to eject ink onto the drum to form another portion of the ink image during an additional imaging revolution (block 532). The controller then determines if additional imaging revolutions are required to print corresponding additional portions of the image data from the leading edge to the trailing edge (block 536). If additional revolutions are needed to print the image data, the process continues with the processing described above with reference to block 528 and repeats until all of the additional imaging revolutions have been printed except the remaining portion of the first imaging revolution. Once all the additional revolutions have been printed, the controller operates the printhead actuator to move the printhead in the cross-process direction to align the inkjets in the printhead with the portion of the first revolution printed from the interior portion to the trailing edge (block 538). The controller then operates the printhead with reference to the image data at the leading edge to the position adjacent the interior portion used to print on the first split revolution to print the remaining portion of the first imaging revolution. This operation of the printhead aligns the remaining portion of the first portion of the ink image with the first portion of the ink image to complete the split imaging revolution (block 540).

After the imaging is complete, the controller operates the drum actuator to decelerate the image drum to the transfix velocity (block 544). The controller can be configured to immediately decelerate the image drum to the transfix velocity to reduce time where the image drum is rotating without imaging, transfixing, or applying release agent. The controller then operates the transfix actuator to engage the transfix roller with the image drum to form the transfix nip (block 548). The controller signals the media transport to insert a media sheet into the transfix nip as the leading edge of the ink image on the image drum enters the nip (block 552). As the ink image and the media sheet pass through the nip, the image is transferred from the image drum and fixed onto the media sheet. The controller then determines if additional image data corresponding to additional pages is available to print (block 556). If more pages are to be printed, the process continues with the processing described above with reference to block 508. If no additional image data is available, then the process terminates (block 560).

It will be appreciated that variations of the above-disclosed system and method and other features, and functions, or alternatives thereof, may be desirably combined into many other different systems or applications. Various presently unforeseen or unanticipated alternatives, modifications, variations, or improvements therein may be subsequently made by those skilled in the art, which are also intended to be encompassed by the following claims.

What is claimed is:

1. A method of operating a printer comprising:

rotating a drum in a process direction past a printhead;

operating the printhead with reference to a first portion of image data stored in a memory to eject ink onto the drum as the drum rotates past the printhead in the process direction, the first portion of the image data corresponding from an intermediate edge in the image data to one of a trailing edge and a leading edge; and operating the printhead with reference to a remaining portion of the image data stored in the memory to eject ink onto the drum as the drum rotates past the printhead in the process direction, the remaining portion of the image data corresponding from the other of the trailing edge and the leading edge to an edge within the image data that is adjacent the intermediate edge.

2. The method of claim 1 further comprising:

moving the printhead in a cross-process direction; and operating the printhead with reference to one of the trailing edge and the leading edge in the image data stored in the memory to the other of the trailing edge and the leading edge in the image data to eject ink onto the drum as the drum rotates past the printhead.

3. The method of claim 2 further comprising:

repeating the moving of the printhead and the operating of the printhead with reference to the image data from one of the trailing edge and the leading edge to the other of the trailing edge and the leading edge for a plurality of revolutions of the drum before operating the printhead with reference to the remaining portion of the image data.

4. The method of claim 1 further comprising:

decelerating the rotating drum from a first angular velocity to a second angular velocity after the printhead is operated with reference to the remaining portion of the image data;

engaging a roller with the rotating drum to form a nip; and inserting a media sheet into the nip as a leading edge of the ink on the drum enters the nip to transfer the ink from the rotating drum to the media sheet.

5. The method of claim 3 further comprising:

engaging the rotating drum with an applicator to apply release agent to a portion of a surface of the drum prior to operating the printhead with reference to the first portion of the image data;

commencing operation of the printhead with reference to the first portion of the image data while the applicator is engaged with the rotating drum; and disengaging the applicator from the rotating drum before ink ejected by the printhead reaches the applicator.

6. The method of claim 5, the commencement of the printhead operation further comprising:

commencing operation of the printhead with reference to the first portion of the image data after a portion of the surface of the rotating drum to which release agent has been applied has passed the printhead.

7. The method of claim 6, the disengaging of the applicator further comprising:

disengaging the applicator from the rotating drum after a complete revolution of the surface of the drum has received release agent from the applicator.

8. The method of claim 7 wherein the operation of the printhead for the plurality of revolutions ejects ink onto the surface of the drum at a position where the applicator disengaged from the surface of the drum.

9. A printer comprising:

a printhead;

a drum configured to rotate past the printhead in a process direction; and a controller operatively connected to the printhead, the controller being configured to:

operate the printhead with reference to a first portion of image data stored in a memory to eject ink onto the drum as the drum rotates past the printhead in the process direction, the first portion of the image data corresponding from an intermediate edge in the image data to one of a trailing edge and a leading edge; and operate the printhead with reference to a remaining portion of the image data stored in the memory to eject ink onto the drum as the drum rotates past the printhead in the process direction, the remaining portion of the image data corresponding from the other of the trailing edge and the leading edge to an edge within the image data that is adjacent the intermediate edge.

10. The printer of claim 9 further comprising:

a first actuator operatively connected to the printhead and the controller and configured to move the printhead in a cross-process direction; and the controller being further configured to operate the first actuator to move the printhead in the cross-process direction and to operate the printhead with reference to one of the trailing edge and the leading edge in the image data stored in the memory to the other of the trailing edge and the leading edge in the image data to eject ink onto the drum as the drum rotates past the printhead.

11. The printer of claim 10, the controller being further configured to:

repeat the moving of the printhead and the operating of the printhead with reference to the image data from one of the trailing edge and the leading edge to the other of the trailing edge and the leading edge for a plurality of revolutions of the drum before operating the printhead with reference to the remaining portion of the image data.

12. The printer of claim 9 further comprising:

a roller;

a second actuator operatively connected to the roller and the controller, the second actuator configured to move the roller into engagement with the rotating drum to form a nip;

a third actuator operatively connected to the rotating drum and the controller, the third actuator configured to rotate the rotating drum at one of a number of predetermined angular velocities;

a media transport operatively connected to the controller and configured to insert media sheets into the nip; and the controller being further configured to:

operate the third actuator to decelerate the rotating drum from a first angular velocity to a second angular velocity after the printhead is operated with reference to the remaining portion of the image data;

operate the second actuator to engage the roller with the rotating drum to form the nip; and operate the media transport to insert a media sheet into the nip as a leading edge of the ink on the drum enters the nip to transfer the ink from the rotating drum to the media sheet.

13. The printer of claim 11 further comprising:

an applicator configured to apply release agent to a surface of the drum;

a fourth actuator configured to move the applicator into engagement with the surface of the drum; and the controller being further configured to:

operate the fourth actuator to engage the applicator with the rotating drum to apply release agent to a portion of the surface of the drum prior to operating the printhead with reference to the first portion of the image data;

commence operation of the printhead with reference to the first portion of the image data while the applicator is engaged with the rotating drum; and operate the third actuator to disengage the applicator from the rotating drum before ink ejected by the printhead reaches the applicator.

14. The printer of claim 13, the commencement of the printhead operation further comprising:

commencing operation of the printhead with reference to the first portion of the image data after a portion of the surface of the rotating drum to which release agent has been applied has passed the printhead.

15. The printer of claim 14, the controller being further configured to disengage the applicator from the rotating drum after a complete revolution of the surface of the drum has received release agent from the applicator.

16. The printer of claim 15 wherein the operation of the printhead for the plurality of revolutions ejects ink onto the surface of the drum at a position where the applicator disengaged from the surface of the drum.

* * * * *